US005231950A

United States Patent [19]

Poulos

[11] Patent Number: 5,231,950

[45] Date of Patent: Aug. 3, 1993

[54] HYDROFOIL FOR WATERCRAFT

[76] Inventor: John G. Poulos, 125 Lincoln Ave., Apt. B4A, Mineola, N.Y. 11501

[21] Appl. No.: 773,678

[22] Filed: Oct. 7, 1991

[51] Int. Cl.[5] ..... B63B 1/24

[52] U.S. Cl. ..... 114/274; 114/280; 440/51

[58] Field of Search ..... 440/66, 67, 68, 113, 440/900, 51; 114/270, 272, 274, 280, 145 A, 162

[56] References Cited

U.S. PATENT DOCUMENTS

| | | | |
|---|---|---|---|
| 3,455,264 | 7/1969 | Castellani | 114/274 |
| 4,100,876 | 7/1978 | Feleus | 114/274 |
| 4,487,152 | 12/1984 | Larson . | |
| 4,744,779 | 5/1988 | Koehler | 440/900 |
| 4,756,265 | 7/1988 | Lane | 440/66 |
| 4,977,847 | 12/1990 | Bartlett | 114/274 |
| 4,995,840 | 2/1991 | Seale et al. . | |
| 5,048,449 | 9/1991 | Templeman | 114/274 |

*Primary Examiner*—Jesûs D. Sotelo
*Assistant Examiner*—Stephen P. Avila
*Attorney, Agent, or Firm*—Hoffmann & Baron

[57] ABSTRACT

A hydrofoil for watercraft is provided. The hydrofoil includes a generally flat body including an upwardly extending wing for providing low speed torque control and rudders extending from the bottom surface of the body to provide high speed torque control. The hydrofoil is adapted for mounting to an anti-cavitation plate. The depth of the hydrofoil can be controlled through the use of shims or a bracket including an offset arm to which the hydrofoil is mounted. The angular position of the hydrofoil is adjustable in the horizontal plane, thereby allowing the rudders to compensate for the lateral torque produced by a propeller.

22 Claims, 13 Drawing Sheets

HYDROFOIL FOR WATERCRAFT

BACKGROUND OF THE INVENTION

1. Field of the Invention

The field of the invention relates to hydrofoils of the type secured to the motor post of an outboard motor.

2. Brief Description of the Related Art

The advantages of hydrofoils are becoming increasingly well recognized by boaters. When used in conjunction with outboards or stern drives, such hydrofoils provide faster planing, increased control, and greatly reduced bow rise. The increased stability provided by such devices reduces the chances of flipping relatively unstable crafts, such as dingies and inflatables, in rough water or high wind. Steering response is quickened in most watercraft, and fuel savings are also generally obtained.

U.S. Pat. No. 4,487,152 discloses one type of hydrofoil, which is also referred to as a stabilizer. The disclosed structure includes a nose portion and a pair of delta-shaped wings extending from the nose portion.

A different construction is disclosed in U.S. Pat. No. 4,995,840. A pair of independent, generally triangular-shaped fins are secured to an anti-cavitation plate on a motor post of an outboard motor. Each fin includes a tapered leading edge and a thickened, drag-inducing trailing edge.

SUMMARY OF THE INVENTION

It is an object of the invention to provide a hydrofoil which provides superior control and lift for an operator of a boat.

It is another object of the invention to provide a hydrofoil which is easily adjusted to compensate for the torque of a propeller with which it is associate.

A still further object of the invention is to provide a hydrofoil which can be mounted at different depths.

In accordance with these and other objects of the invention, a hydrofoil is provided which includes a generally foil-shaped body having a tapered leading edge and a trailing edge. A recessed side edge portion is connected to the hydrofoil body for mounting it to an anti-cavitation plate of a motor post. The body further includes a top surface and a bottom surface. A plurality of at least generally parallel torque control rudders extend from the bottom surface of the hydrofoil body and extend at least part way between the leading the trailing edges thereof. The hydrofoil preferably also includes a winglet extending upwardly from the top surface of the body. The winglet functions as a low speed torque control rudder and acts to block relatively high pressure water from encroaching upon the upper foil surface.

The recessed side edge portion of the hydrofoil is preferably provided with an elongate, vertically extending slot which communicates with the recess in the side edge portion. The orientation of the hydrofoil with respect to the motor post may accordingly be varied by positioning the slot in a selected position with respect to a drilled opening in the anti-cavitation plate during the mounting procedure. It will be appreciated that the orientation of the rudders with respect to the motor post will be varied depending upon the orientation of the hydrofoil body, thereby varying the torque control to be provided.

In accordance with another embodiment of the invention, a hydrofoil assembly is provided for allowing a hydrofoil to be mounted at a selected height with respect to an anti-cavitation plate. The assembly includes a hydrofoil including a leading edge, a trailing edge, a recessed side edge portion, and means for mounting the hydrofoil at a plurality of heights with respect to an anti-cavitation plate. Such mounting means may include a bracket including an offset arm which extends either above or below the plane of the anti-cavitation plate, depending upon the orientation of the bracket with respect to the anti-cavitation plate. Alternatively, the recess within the side edge portion of the hydrofoil may be greater in height than the thickness of the anti-cavitation plate. One or more shims may be positioned within the recess when the hydrofoil is mounted to the anti-cavitation plate. The positions of the shims with respect to the plate determine whether the hydrofoil is above, below or coplanar with the plate. The depth of the hydrofoil in the water can thereby be controlled. Means may also be provided for adjusting the orientation of the hydrofoil with respect tot he anti-cavitation plate, thereby varying the angle at which the hydrofoil attacks the water.

DETAILED DESCRIPTION OF THE INVENTION

Figure 1:
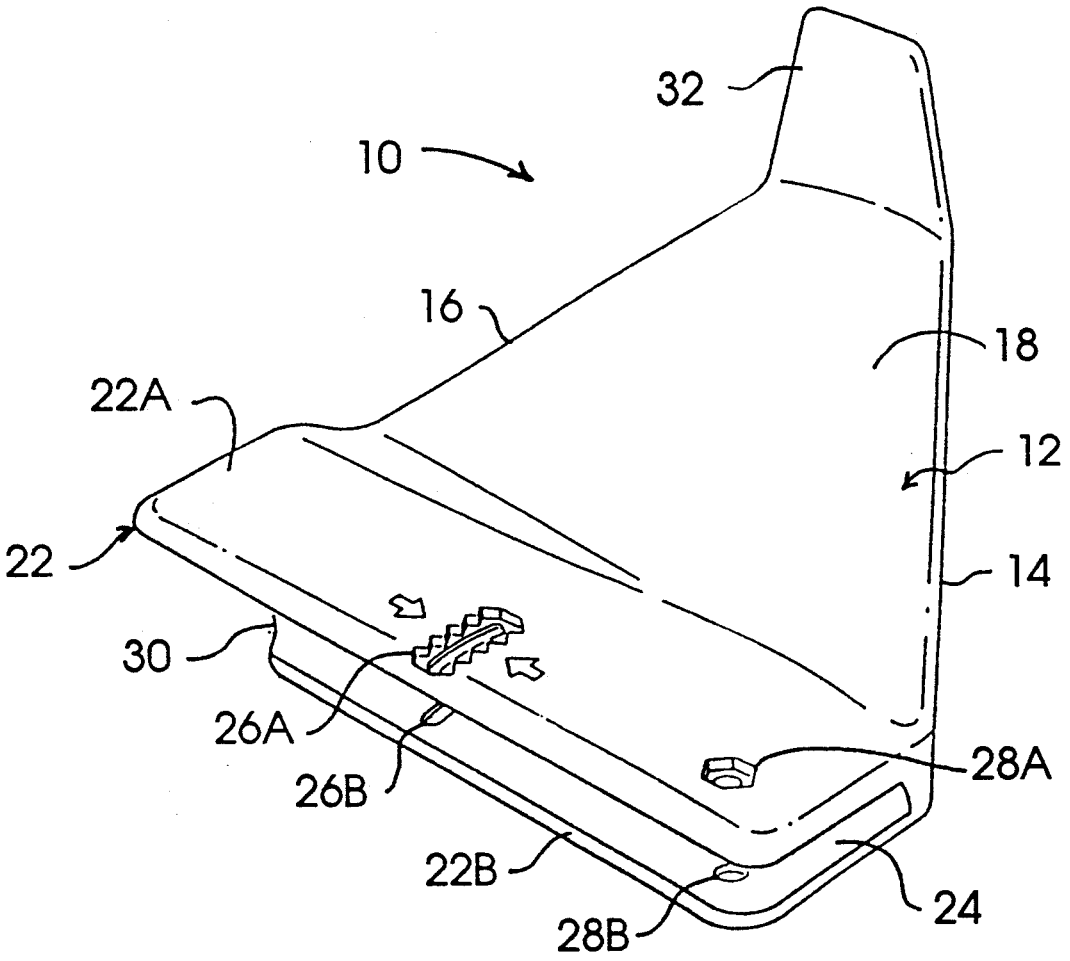
FIG. 1 is a top perspective view of a hydrofoil according to the invention.

A first embodiment of a hydrofoil 10 according to the invention is shown in FIGS. 1–8. The hydrofoil includes a generally trapezoidal body 12 having a tapered leading edge 14, a trailing edge 16, a top surface 18 and a bottom surface 20. A side edge portion 22 is formed integrally with the body 12, and is used for connection to an anti-cavitation plate. The hydrofoil is molded from a polymeric material such as polypropylene, and is semi-rigid in construction to avoid overstressing the anti-cavitation plate.

The side edge portion 22 of the hydrofoil includes an elongate recess 24 which divides it into upper and lower plate-like sections 22A, 22B. The sections are substantially parallel to each other. The top section 22A includes an arcuate slot 26A having generally serrated side walls which define a plurality of triangular teeth. Index markings (not shown) may additionally or alternatively be provided adjacent to the slot. A opening 28A defined in part by hexagonal side walls also extends through the top section 22A. The bottom section 22B includes an arcuate slot 26B and a circular opening 28B which are aligned, respectively, with the slot 26A and opening 28A within the top section. The rear portion of the bottom section 22B includes a cut out area 30 to provide sufficient clearance for anti-electrolysis electrodes which are present on some boats.

An upwardly extending winglet 32 extends between the leading and trailing edges of the hydrofoil on the side opposite from the side edge portion 22. If desired, this winglet may extend beneath the bottom surface 20 as well. It forms an angle of slightly greater than 90° with respect to the top surface 18 of the body 12, e.g. 97°.

Figure 5:
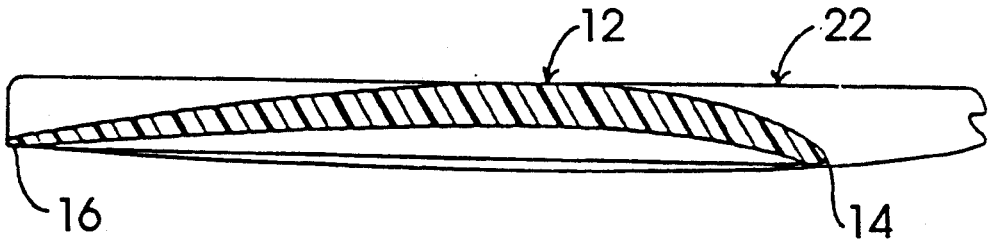
FIG. 5 is a sectional view thereof taken between the leading and trailing edges of the hydrofoil.

The body 12 of the hydrofoil is generally arcuate between the leading and trailing edges thereof, as shown in FIG. 5. The top surface 18 thereof may be smooth or rough. A rough surface may be preferable for reducing drag.

Figure 2:
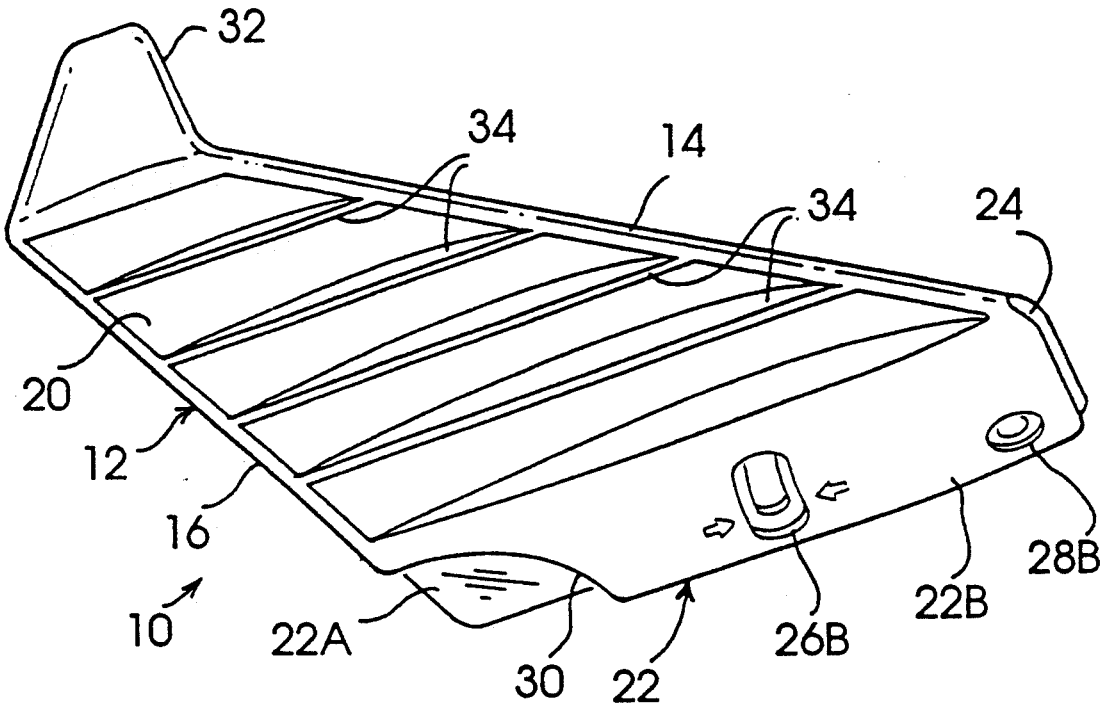
FIG. 2 is a bottom perspective view thereof.
Figure 3:
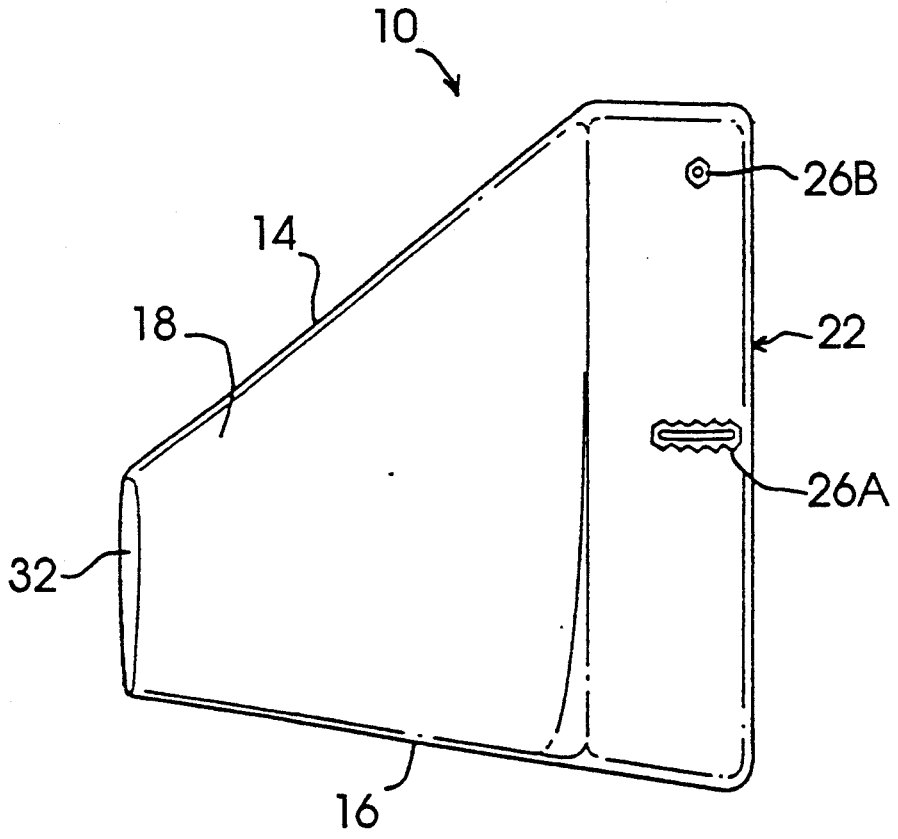
FIG. 3 is a top plan view thereof.
Figure 4:
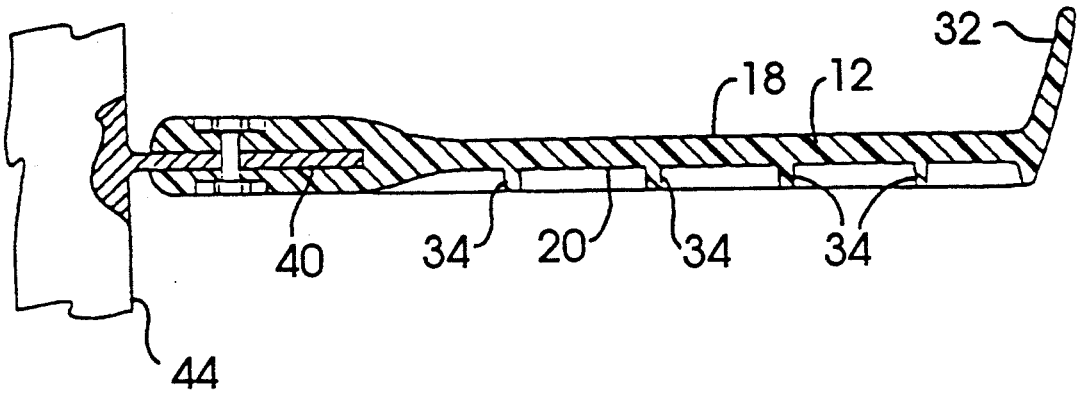
FIG. 4 is a sectional view of the hydrofoil as secured to an anti-cavitation plate.

A plurality of torque control rudders 34 extend from the bottom surface 20 of the hydrofoil body 12, as best shown in FIGS. 2 and 4. The rudders extend substantially between the leading and trailing edges 14, 16 thereof, and are substantially parallel to each other and to the winglet 32. They also have flat, coplanar bottom surfaces.

As shown in FIG. 4, the hydrofoil 10 may be mounted to an anti-cavitation plate 40 by aligning the slots 26A, 26B and openings 28A, 28B within the side edge portion 22 with a pair of openings 42 within the plate. Two sets of nuts and bolts are employed for securing the hydrofoil to the plate 40. The orientation of the hydrofoil with respect to the motor post 44 is determined by positioning the slots 26A, 26B in a selected position with respect to the corresponding openings in the anti-cavitation plate. The bolt extending through the openings 28A, 28B may be used as a pivot in order to properly position the slots. The teeth extending into the upper slot 26A engage the nut used to secure the hydrofoil. The hydrofoil is accordingly prevented from pivoting about the bolt extending through the openings 28A, 28B once the second bolt is secured with the slots.

Figure 6:
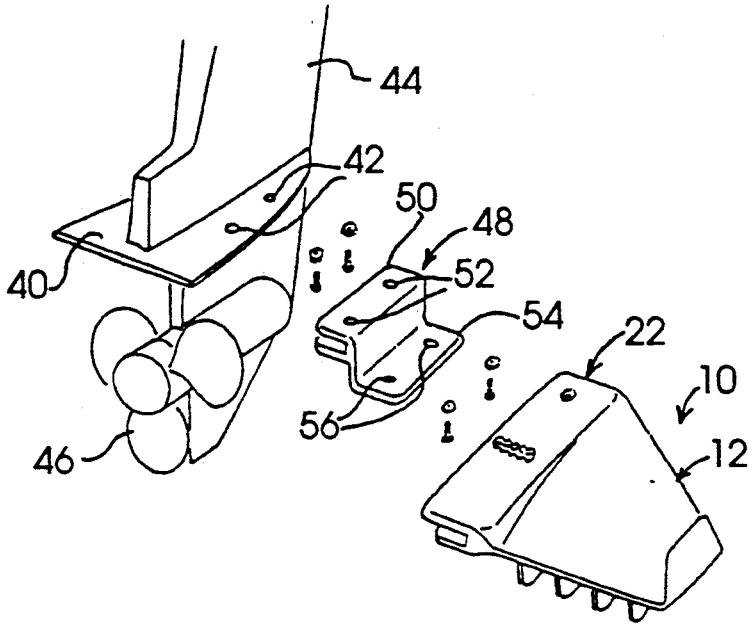
FIG. 6 is an exploded top perspective view showing a motor post, a bracket and a hydrofoil according to the invention.
Figure 7:
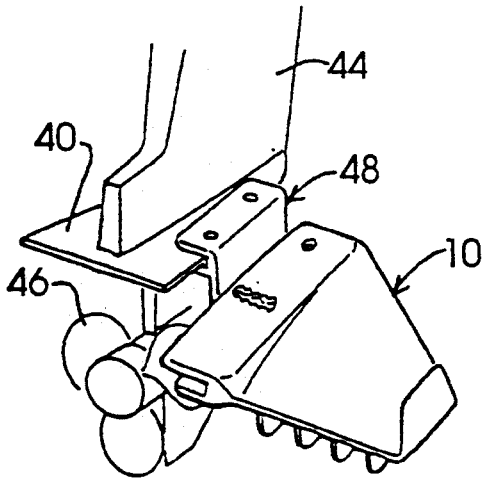
FIG. 7 is a top perspective view showing the hydrofoil mounted to the bracket so that it is positioned beneath the plane of the anti-cavitation plate.
Figure 8:
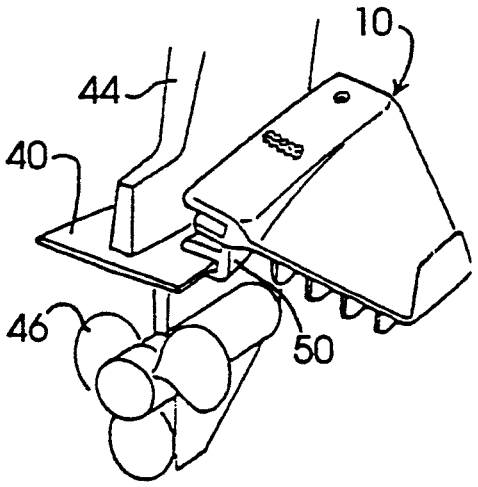
FIG. 8 is a top perspective view showing the hydrofoil mounted to the bracket so that it is positioned above the plane of the anti-cavitation plate.
Figure 9:
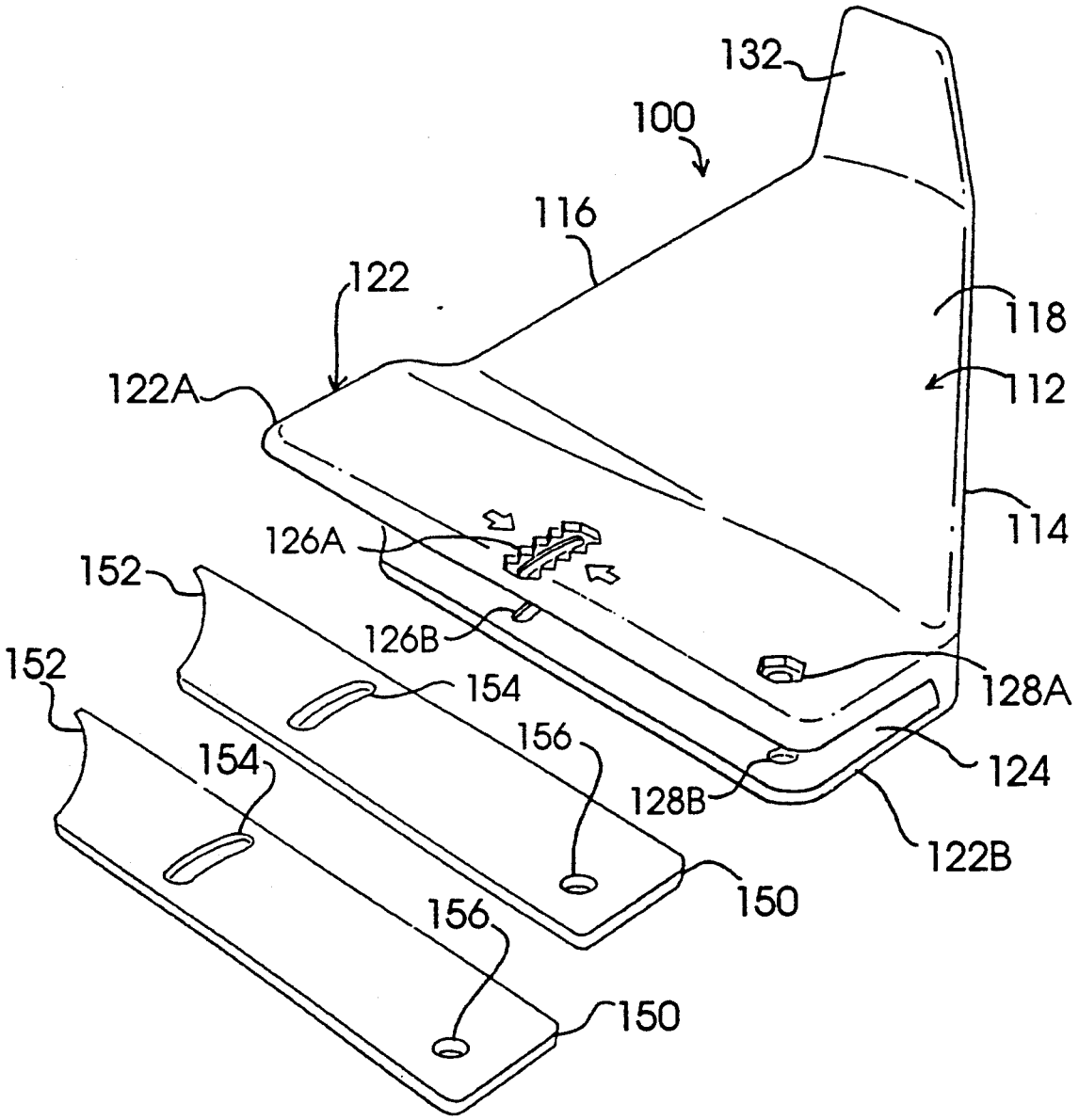
FIG. 9 is an exploded top perspective view of a second hydrofoil according to the invention which includes mounting shims.
Figure 10:
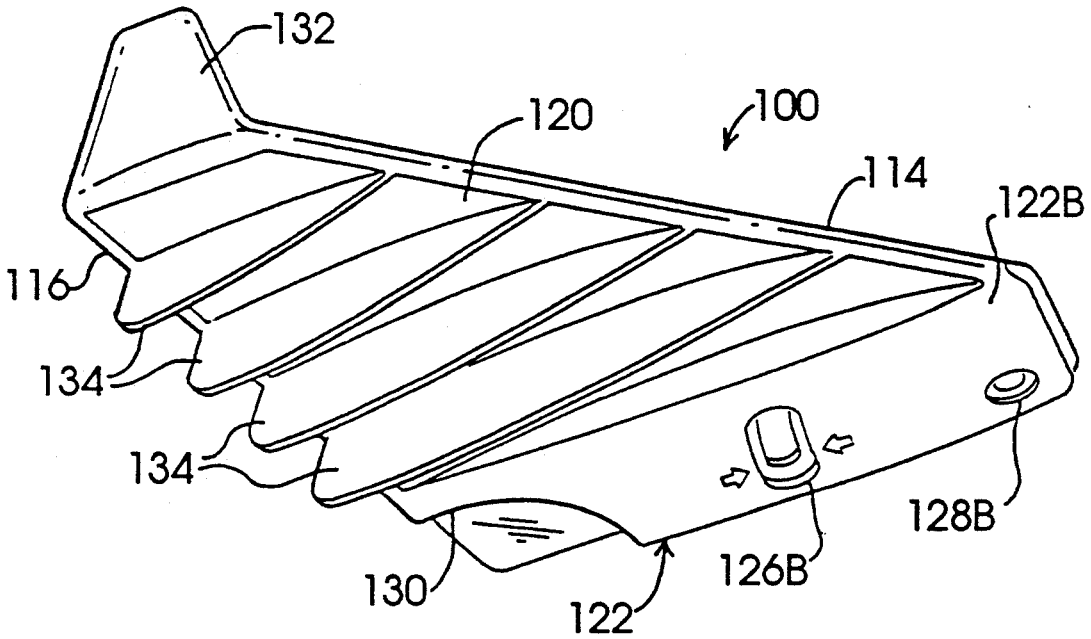
FIG. 10 is a bottom perspective view thereof.
Figure 11:
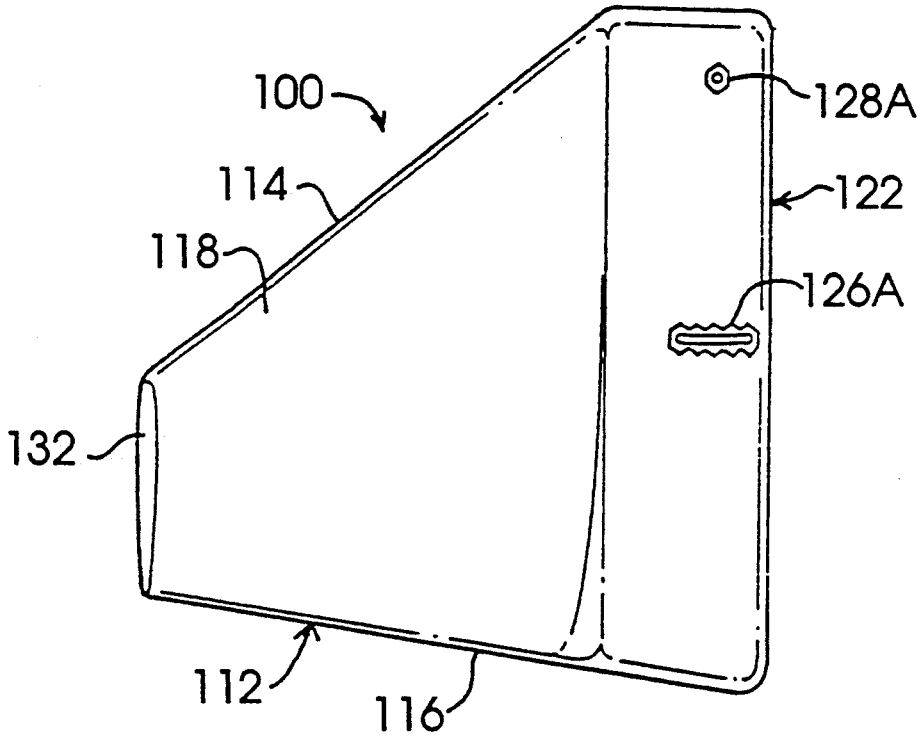
FIG. 11 is a top plan view thereof.
Figure 12:
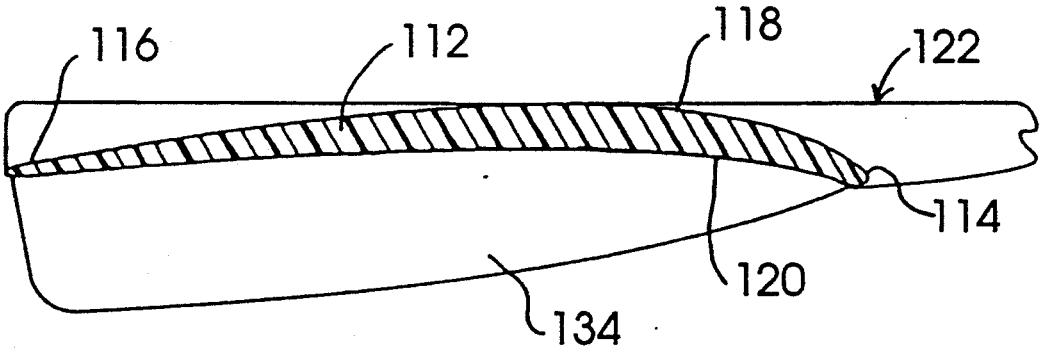
FIG. 12 is a sectional view taken between the leading and trailing edges thereof.

An alternative system for mounting a hydrofoil is shown in FIGS. 6–8. This system allows the hydrofoil to be mounted at any of three selected heights with respect to the anti-cavitation plate 40 and associated propeller 46. By mounting the hydrofoil directly to the anti-cavitation plate in the manner shown in FIG. 4, the hydrofoil is generally coplanar with the plate. If the user prefers to raise or lower the hydrofoil with respect to the plate to affect various performance characteristics of his boat, a bracket 48 is first mounted to the plate 40. The hydrofoil is then mounted to the bracket.

The bracket 48 includes a recessed body 50 having a pair of openings 52 extending therethrough. The height of the recess generally corresponds to the thickness of the anti-cavitation plate 40. An arm 54 including a pair of openings 56 extends in offset relation from the body 50. The thickness of the arm 54 corresponds to the distance between the top and bottom sections of the side edge portion 22 of the hydrofoil. The hydrofoil is mounted to this arm in the same manner it is mounted to the anti-cavitation plate 40, as described with respect to FIG. 4. The orientation of the bracket with respect to the anti-cavitation plate 40 determines whether the hydrofoil is generally below the plane of the plate, as shown in FIG. 7, or above this plane as shown in FIG. 8.

In operation, the mounting arrangement for the hydrofoil, the winglet 32, and the rudders 34 combine to provide superior torque control at all speeds. Steering of the vessel is accordingly facilitated. The winglet 32 functions as a low speed torque control rudder as well as a pressure barrier. It is oriented so as to counteract the natural tendency of a vessel to turn to one side or another when it starts in motion. The vessel will accordingly steer in a straight line.

The rudders 34 function as high speed torque control rudders, and compensate for the torque exerted by the propeller as the vessel is in motion. The sharpness of high speed cornering may also be increased. Directional control of the vessel is accordingly enhanced.

The embodiment of the invention shown in FIGS. 9–15 is similar to that shown in FIGS. 1–8. It is designed to provide even superior high speed torque control. In addition, the depth at which the hydrofoil 100 is positioned may be controlled in a different manner.

The hydrofoil 100 includes a generally trapezoidal body 112 having a tapered leading edge 114, a trailing edge 116, a top surface 118 and a bottom surface 120. A side edge portion 122 is formed integrally with the body.

Figure 16:
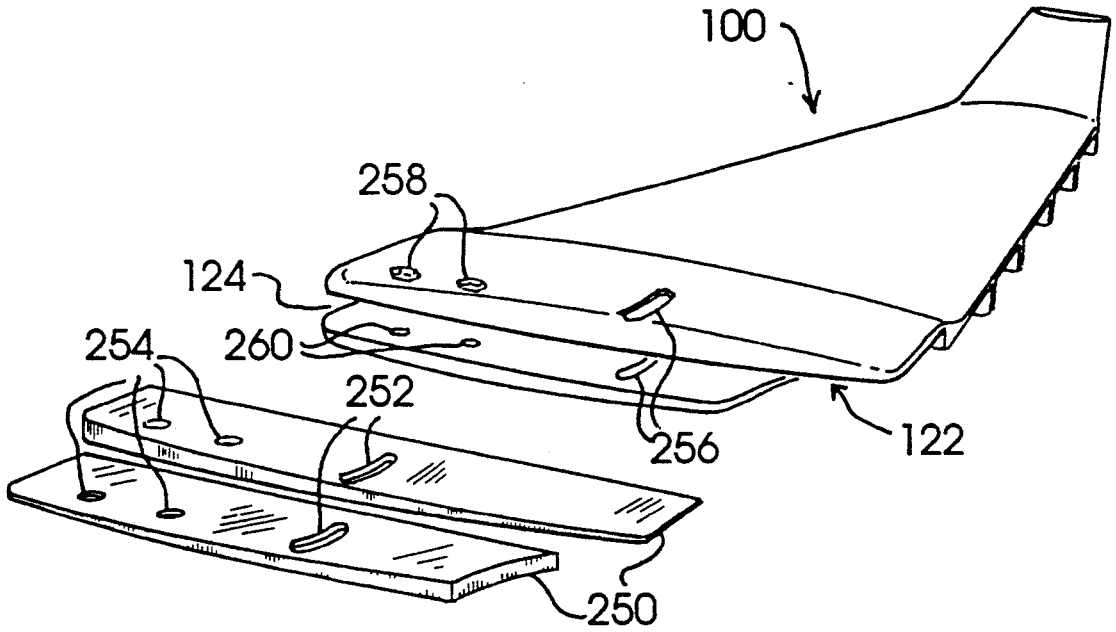
FIG. 16 is an exploded, perspective view of a hydrofoil assembly including a pair of wedge-shaped shims.
Figure 17:
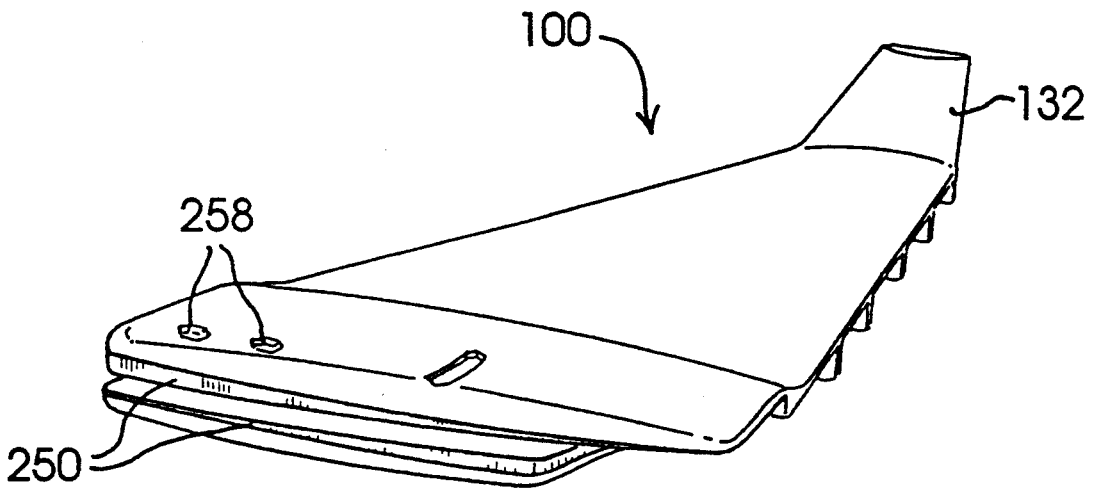
FIG. 17 is a top perspective view of the assembly of FIG. 16 showing the shims positioned within a recess within the hydrofoil.

The side edge portion 122 includes an elongate recess 124 which divides it into upper and lower plate-like sections 122A, 122B. These sections are separated by a distance which is considerably greater than the distance separating the corresponding sections 22A, 22B of the hydrofoil 10 discussed above. The top section 122A includes an arcuate slot 126A having side walls which define a plurality of triangular teeth. An opening 128A defined in part by hexagonal side walls also extends through the top section 122A. (Preferably two such openings are provided, as shown in FIGS. 16 and 17). The bottom section 122B includes an arcuate slot 126B and a circular opening 128B which are aligned, respectively, with the slot 126A and opening 128A within the top section 122A. The rear portion of the bottom section 122B includes a cut out area 130.

An upwardly extending winglet 132 similar to that of the first described hydrofoil 10 extends upwardly from the top surface 118 of the hydrofoil body 112. Torque control rudders 134 extend from the bottom surface 120 thereof. As shown in FIGS. 10, 12 and 13–15, the rudders extend considerably beneath the plane defining the bottom of the hydrofoil 100, unlike those of the first described hydrofoil 10 which have planar bottom surfaces which are substantially coplanar with the bottom thereof. In addition, the rudders have curved bottom surfaces such that the rudders increase in height between the leading edge 114 of the hydrofoil 100 and the trailing edge 116 thereof.

Figure 13:
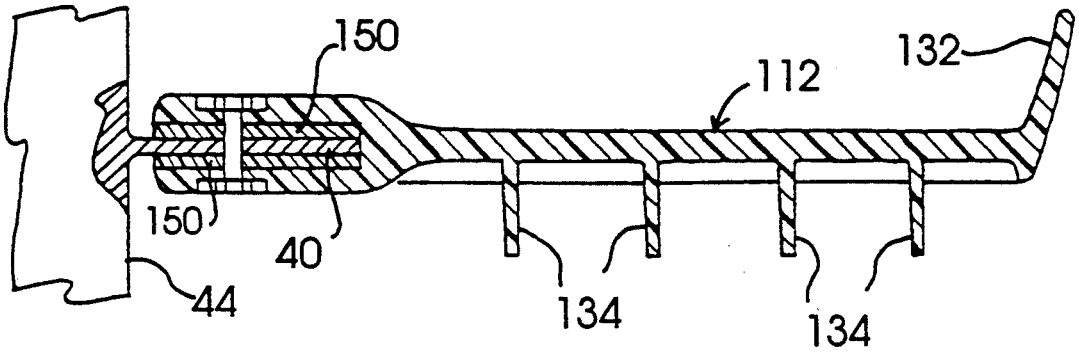
FIG. 13 is a sectional view of the hydrofoil mounted in a first position with respect to an anti-cavitation plate.
Figure 14:
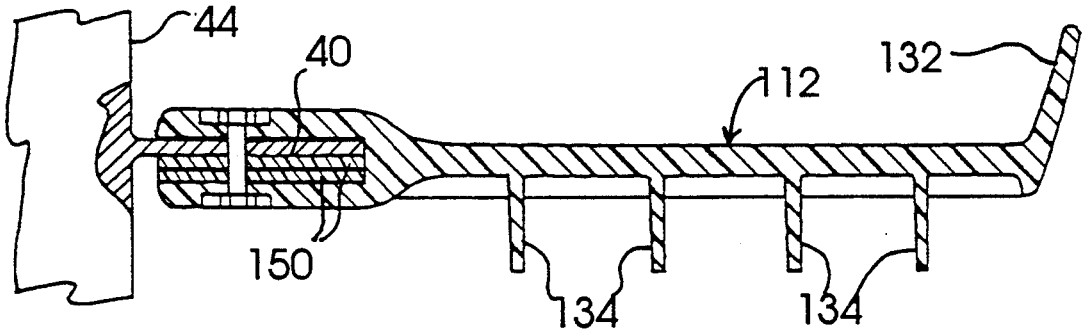
FIG. 14 is a sectional view of the hydrofoil mounted in a second position with respect to an anti-cavitation plate.
Figure 15:
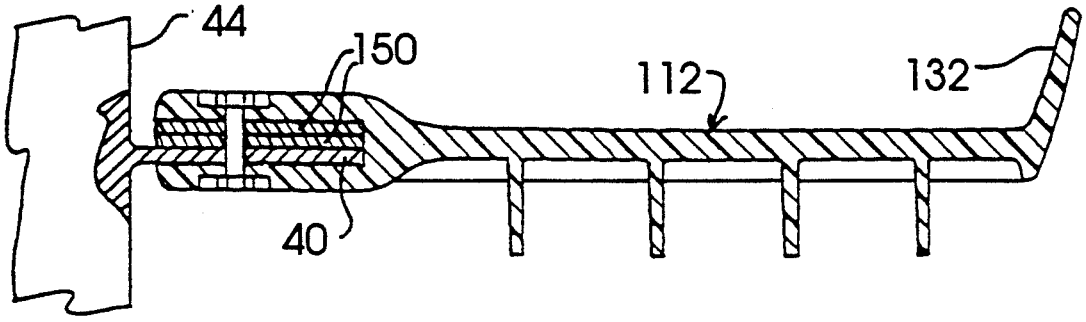
FIG. 15 is a sectional view of the hydrofoil mounted in a third position with respect to an anti-cavitation plate.

FIGS. 13–15 illustrate the manner in which the depth of the hydrofoil 100 may be set by the user. The hydrofoil is provided as a kit including one or more shims 150. The shims are generally rectangular, and each includes a cut out area 152 comparable to the cut out area 130 in the bottom section 122B of the side edge portion 122. They also include an arcuate slot 154 and a circular hole 156 which are capable of alignment with the corresponding structures in the side edge portion of the hydrofoil 100. It will be appreciated that the recess 24 in the side edge portion 22 of the hydrofoil 10 shown in FIGS. 1–8 may be enlarged to permit depth adjustment in a similar manner.

In the arrangement shown in FIG. 13, the anti-cavitation plate 40 is sandwiched between the two shims 150 so that the body 112 of the hydrofoil 100 is substantially coplanar with the plate. Both shims 150 are positioned beneath the plate in the arrangement shown in FIG. 14. The upper section 122B of the side edge portion of the hydrofoil 100 accordingly adjoins the upper surface of the anti-cavitation plate. The body 112 of the hydrofoil is generally beneath the plane defined by the plate when the shims are positioned in this manner. As shown in FIG. 15, the shims are both positioned above the anti-cavitation plate 40 in order to position the body 112 of the hydrofoil generally above the plane of the plate.

Figure 18:
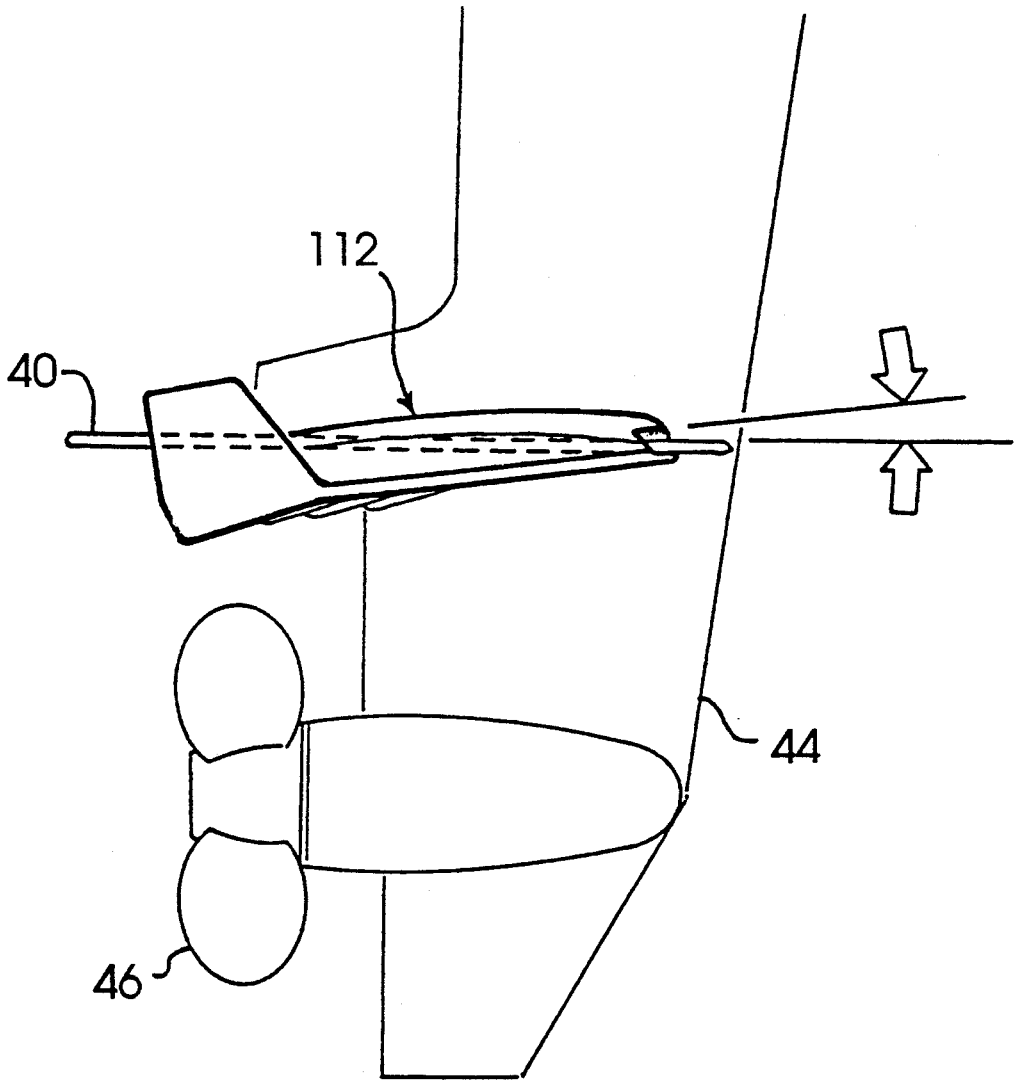
FIG. 18 is a side elevation view showing the assembly of FIG. 17 mounted to an anti-cavitation plate.

Referring to FIGS. 16 and 17, a pair of wedge-shaped shims 250 may be positioned within the recess 124 of the hydrofoil 100 in order to orient the hydrofoil at a selected angle with respect to the anti-cavitation plate. The shims 250 each include an elongate, arcuate opening 252 and a pair of circular openings 254 which are aligned, respectively, with corresponding slots 256 and openings 258, 260 within the side edge portion 122 of the hydrofoil 100. As shown in FIG. 18, the body 112 of the hydrofoil is angled generally upwardly when the shims 250 are employed. This provides lift even at low speed as water is pushed beneath the hydrofoil body 112. In lieu of shims, the recess 124 may simply be formed at an angle with respect to the body 112 in order to position the body in a non-parallel orientation with respect to the anti-cavitation plate. A second alternative would be to mount the hydrofoil to a bracket similar to that shown in FIG. 6 wherein the bracket itself allows the hydrofoil to extend at an angle with respect to the anti-cavitation plate.

It will be appreciated that the hydrofoils as described above are provided as kits including two such hydrofoils, one for each side of the motor post. The appropriate hardware is also provided for mounting the hydrofoils at a selected range of depths.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A hydrofoil for watercraft comprising:

a body having a tapered leading edge, a trailing edge, a top surface, and a bottom surface;

a recessed side edge portion connected to said body for mounting the body to an anti-cavitation plate;

a plurality of torque control rudders extending from the bottom surface of the body and at least part way between the leading and trailing edges, said torque control rudders running substantially parallel to each other and increasing in height from the leading edge towards the trailing edge of the body.

2. A hydrofoil as described in claim 1 including a winglet extending upwardly from the top surface of said body.

3. A hydrofoil as described in claim 2 wherein said winglet defines an edge of said body and extends between the leading and trailing edges thereof.

4. A hydrofoil as described in claim 3 wherein said winglet defines an obtuse angle with respect to the top surface of said body.

5. A hydrofoil as described in claim 1 wherein said rudders each include a bottom surface substantially coplanar with the bottom surface of the side edge portion and with the bottom surfaces of the other rudders.

6. A hydrofoil as described in claim 1 wherein said side edge portion includes means for securing said body at a plurality of angles with respect to a motor post.

7. A hydrofoil as described in claim 6 wherein said means for securing includes a generally arcuate slot extending through said side edge portion and an opening spaced from said slot and extending through said side edge portion.

8. A hydrofoil as described in claim 1 including means for securing said hydrofoil in a non-parallel orientation with respect to an anti-cavitation plate.

9. A hydrofoil as described in claim 1 wherein said body is generally trapezoidal.

10. A hydrofoil assembly for watercraft comprising:

a hydrofoil including a leading edge, a trailing edge, a top surface, and a bottom surface, a recessed side edge portion for receiving an edge portion of an anti-cavitation plate, and a pair of openings extending through said recessed side edge portion; and mounting means for mounting the hydrofoil to an anti-cavitation plate, said mounting means including an elongate shim positionable within said recess, said shim including a pair of openings registrable with the pair of openings extending through the recessed side edge portion of said hydrofoil.

11. An assembly as described in claim 10 including a second shim positionable within said recess, said recess being of sufficient height to receive both of said shims and an anti-cavitation plate in stacked relation to each other.

12. A hydrofoil assembly as described in claim 11, wherein each of said shims has a wedge-shaped configuration.

13. A hydrofoil assembly as described in claim 10 wherein one of the openings extending through the recessed side edge portion of said hydrofoil is an arcuate slot.

14. A hydrofoil assembly as described in claim 13 wherein said hydrofoil includes a plurality of substantially parallel rudders extending from the bottom surface thereof.

15. A hydrofoil assembly as described in claim 14 wherein said hydrofoil includes a winglet extending upwardly from the top surface thereof and running at least generally parallel to said rudders.

16. A hydrofoil for watercraft comprising:

a body having a tapered leading edge, a trailing edge, a top surface, and a bottom surface, and a winglet extending upwardly from the top surface, said winglet defining an edge of said body and extending between the leading and trailing edges, and a recessed side edge portion connected to the body for mounting the body to an anti-cavitation plate.

17. A hydrofoil assembly as described in claim 18, including a torque control rudder extending from the bottom surface of the body and at least part way between the leading and trailing edges.

18. A hydrofoil for watercraft comprising:

a body having a leading edge, a trailing edge, a top surface, and a bottom surface;

a side edge portion connected to the body for mounting the body to an anti-cavitation plate, said side edge poison including first and second openings extending therethrough, at least one of said openings having an elongated configuration, said openings being capable of receiving mounting means extending through said side edge portion so that said body may be mounted to an anti-cavitation plate at a plurality of angular positions with respect to a motor post, and a torque control rudder extending between said leading and trailing edges and substantially perpendicularly from said bottom surface of said body, said torque control rudder being capable of compensating for torque exerted by a propeller when said body is mounted to an anti-cavitation plate.

19. A hydrofoil as described in claim 18 including a plurality of parallel torque control rudders extending from the bottom surface of said body.

20. A hydrofoil as described in claim 18 including a winglet extending upwardly from the top surface of said body and defining an edge portion of said body between said leading and trailing edges opposite to said side edge portion.

21. A hydrofoil as described in claim 18, wherein said opening of elongated configuration is a generally arcuate slot.

22. A hydrofoil for watercraft comprising:

a hydrofoil including a leading edge, a trailing edge, a top surface, and a bottom surface, and mounting means for mounting the hydrofoil to an anti-cavitation plate, said mounting means including a bracket for positioning said hydrofoil at a plurality of heights with respect to an anti-cavitation plate, said bracket including a recessed body and an arm extending from said recessed body, said recessed body being adapted to be secured to an anti-cavitation plate, and said arm adapted to be secured to said hydrofoil such that said hydrofoil is positioned at a different depth than that of an anti-cavitation plate to which the bracket is securable.

* * * * *